US011517116B2

(12) United States Patent
Yi

(10) Patent No.: US 11,517,116 B2
(45) Date of Patent: Dec. 6, 2022

(54) ANGLE ADJUSTMENT ASSEMBLY AND SOFA

(71) Applicant: Leping Yi, Shenzhen (CN)

(72) Inventor: Leping Yi, Shenzhen (CN)

( * ) Notice: Subject to any disclaimer, the term of this patent is extended or adjusted under 35 U.S.C. 154(b) by 207 days.

(21) Appl. No.: 17/137,418

(22) Filed: Dec. 30, 2020

(65) Prior Publication Data

US 2022/0202191 A1 Jun. 30, 2022

(51) Int. Cl.

| | |
|---|---|
| ***E05D 11/08*** | (2006.01) |
| ***E05D 3/02*** | (2006.01) |
| ***A47C 7/52*** | (2006.01) |
| ***A47C 17/04*** | (2006.01) |
| ***E05D 5/04*** | (2006.01) |
| *E05D 5/10* | (2006.01) |

(52) U.S. Cl.

CPC ..... *A47C 17/04* (2013.01); *E05D 3/02* (2013.01); *E05D 5/046* (2013.01); *E05D 2005/108* (2013.01)

(58) Field of Classification Search

CPC ..... E05D 11/082; E05D 11/08; E05D 11/081; E05D 11/084; E05D 11/06; A47C 1/026; A47C 1/027; A47D 1/002

See application file for complete search history.

(56) References Cited

U.S. PATENT DOCUMENTS 1,753,470 A * 4/1930 Meyer ..... A47C 1/06 297/79
3,792,905 A * 2/1974 Johnson ..... A61G 15/02 297/330
4,394,047 A * 7/1983 Brunelle ..... B60N 2/20 16/339
4,534,594 A * 8/1985 Lucien ..... B64D 11/0643 297/423.27
5,406,678 A * 4/1995 Kaden ..... G06F 1/1681 16/342
5,898,953 A * 5/1999 Paxon ..... A61G 5/14 297/DIG. 10
5,956,810 A * 9/1999 Spaeth ..... E05D 11/06 16/358
6,467,129 B1 * 10/2002 Bae ..... G06F 1/1616 16/337
7,044,554 B2 * 5/2006 Furtado ..... B60N 2/806 297/376
7,320,152 B2 * 1/2008 Lowry ..... E05C 17/64 16/334
8,104,142 B2 * 1/2012 Lowry ..... E05F 1/1215 16/307

(Continued)

*Primary Examiner* — Shin H Kim

(57) ABSTRACT

An angle adjustment assembly includes a first connecting piece including first side plates, a second connecting piece including second side plate, and a limiting rod. The first side plates are hinged to the second side plates. The first side plates include a through hole that is arc-shaped and centered at a hinge joint of the first side plates and the second side plates. A path of the through hole has at least one expansion groove. The limiting rod is axially movably connected with a corresponding second side plate. The limiting rod includes a first sections and a second section. A diameter of the first section is smaller than a diameter of the second section. A size of the first section matches a size of the through hole. A size of the second section matches a size of the at least one expansion groove.

12 Claims, 4 Drawing Sheets

(56) References Cited

U.S. PATENT DOCUMENTS

| | | | | |
|---|---|---|---|---|
| 9,644,412 | B2 * | 5/2017 | Novin | E05D 3/02 |
| 11,422,591 | B2 * | 8/2022 | Chen | E05D 3/122 |
| 2002/0042970 | A1 * | 4/2002 | Liao | G06F 1/1616 16/337 |
| 2006/0048337 | A1 * | 3/2006 | Lowry | G06F 1/1681 16/342 |
| 2015/0121654 | A1 * | 5/2015 | Novin | E05D 11/082 16/273 |
| 2022/0260302 | A1 * | 8/2022 | Xia | E05D 3/18 |

* cited by examiner

ANGLE ADJUSTMENT ASSEMBLY AND SOFA

TECHNICAL FIELD

The present disclosure relates to a field of connecting piece technology, and in particular to an angle adjustment assembly and a sofa.

BACKGROUND

A sofa comprises multiple components. Most of the components are fixedly connected, that is, angles of the components do not need to be adjusted. However, angles of some components need to be adjustable. For example, in a foldable sofa or a stretchable sofa, a sofa seat is connected with supporting legs through connecting assemblies, and an angle of each supporting leg is adjustable. The supporting legs are folded to fold the sofa and the supporting legs are expanded to spread the sofa. However, the conventional supporting legs are only hinged with the sofa seat to realize an adjustment of the angle, the angle of the supporting legs is unable to be fixed.

SUMMARY

In view of this, in order to solve one of the technical problems in the prior art to a certain extent, it is necessary to provide an angle adjustment assembly and a sofa. An angle of the first connecting piece and a second connecting piece is fixable, and it is convenient to release a fixing effect to change the angle.

The present disclosure provides an angle adjustment assembly. The angle adjustment assembly comprises a first connecting piece, a second connecting piece, and a limiting rod. The first connecting piece comprises first side plates. The second connecting piece comprises second side plates. The first side plates are hinged to the second side plates. The first side plates comprise a through hole. The through hole is arc-shaped. The through hole is centered at a hinge joint of the first side plates and the second side plates. A path of the through hole has at least one expansion groove. The limiting rod is axially movably connected with a corresponding second side plate. The limiting rod comprises a first sections and a second section. A diameter of the first section of the limiting rod is smaller than a diameter of the second section of the limiting rod. A size of the first section of the limiting rod matches a size of the through hole. A size of the second section of the limiting rod matches a size of the at least one expansion groove. The limiting rod is configured to be axial moved to make the first section of the limiting rod receive in the through hole or make the second section of the limiting rod receive in the at least one corresponding expansion groove.

The present disclosure provides a sofa. The sofa comprises a first component, a second component, and angle adjustment assemblies. The first component is connected to first connecting pieces. The second component is connected to second connecting pieces.

It is noted that in above solutions, the limiting rod is moveable axially. When the first section of the limiting rod is received in the through hole, the first side plates rotates with respect to the second side plate, and the limiting rod moves along the path of the through hole along with the second side plates, then an angle of the sofa is adjusted. When the second section of the limiting rod is received the expansion groove, the second section of the limiting rod is unable to move on the path of the through hole. The second side plates are fixed with the first side plate by the limiting rod, and the angle is fixed. Angle adjustment or angle fixation of the present disclosure is realized by axially moving the limiting rod.

Figure 1:
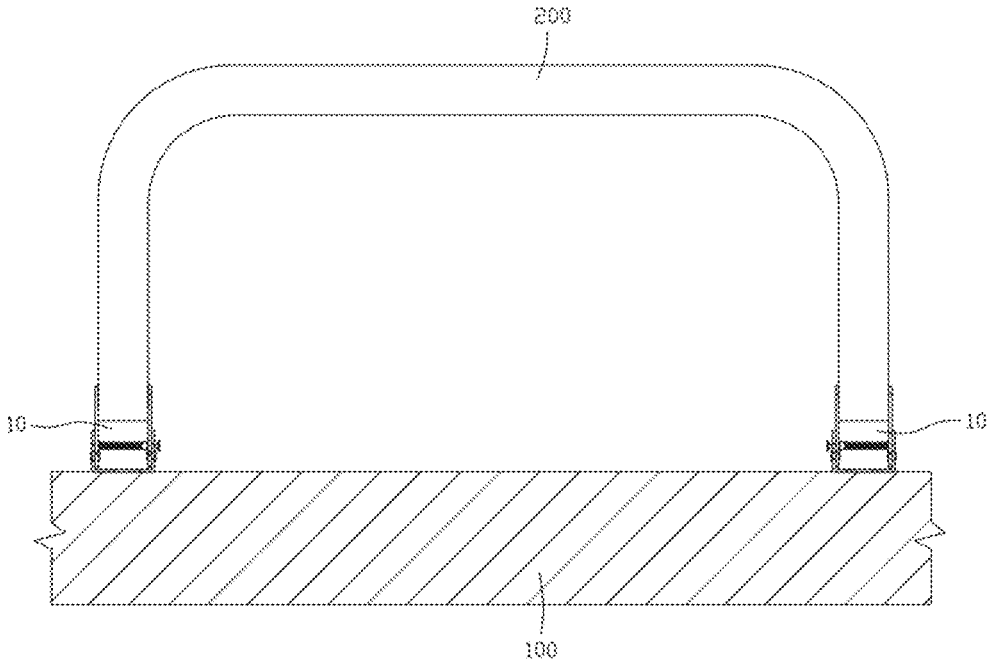
FIG. 1 is a schematic diagram showing portions of structures of a sofa according to one embodiment of the present disclosure.

The following specific embodiments will further illustrate the present disclosure in conjunction with the above-mentioned drawings.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure. It can be understood that the drawings are only provided for reference and illustration, and are not used to limit the present disclosure. The connection relationship shown in the drawings is only for the convenience of clear description and does not limit the connection mode.

Figure 2:
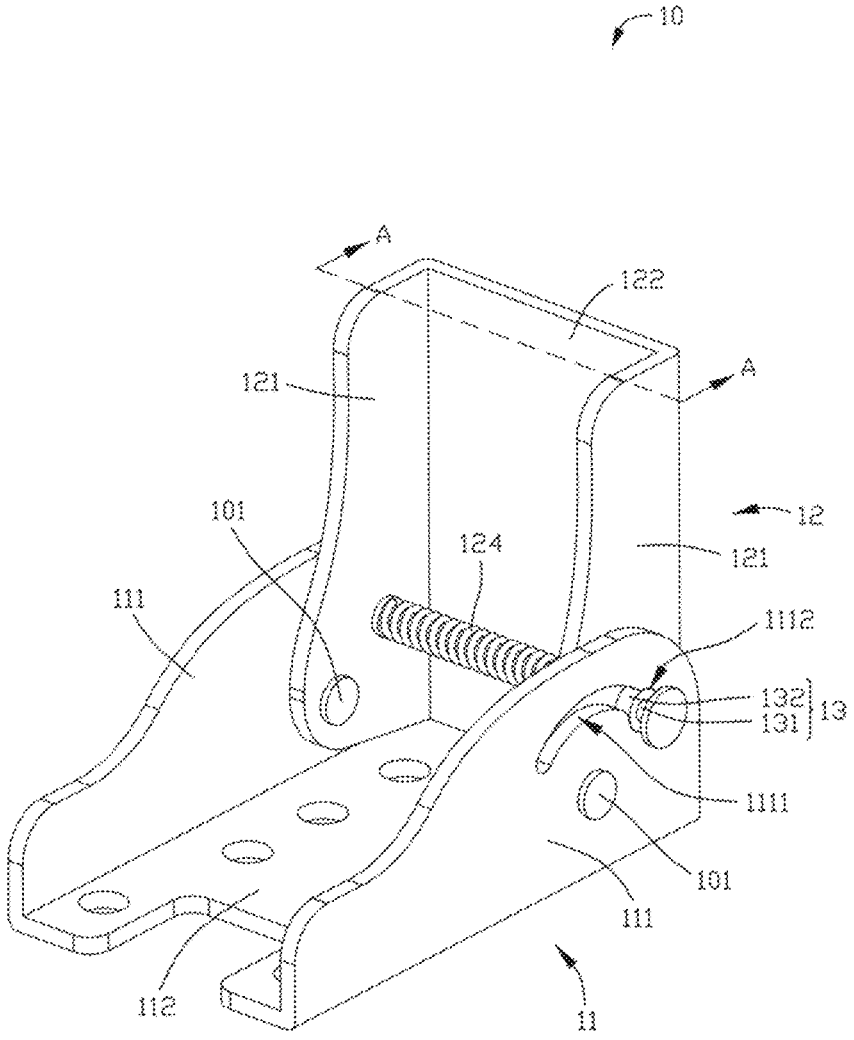
FIG. 2 is a schematic diagram showing a structures of an angle adjustment assembly according to one embodiment of the present disclosure.

In one embodiment, the present disclosure provides a sofa. As shown in FIGS. 1 and 2, the sofa comprises a first component 100, a second component 200, and angle adjustment assemblies 10. Each of the angle adjustment assemblies 10 comprise a first connecting piece 11 and a second connecting piece 12. The first component 100 is connected to first connecting pieces 11. The second component is connected to second connecting pieces 12. Through the angle adjusting assemblies 10, the angle of the first component 100 relative to the second component 200 is adjusted. In one embodiment, the first component 100 is a sofa seat; the second component 200 is a sofa leg. The sofa leg is a U-shaped sofa leg. The sofa comprises two angle adjustment assemblies 10. Two ends of the second component 200 are connected with a respective second connecting piece 12.

In the embodiment, each angle adjustment assembly 10 comprises the first connecting piece 11, the second connecting piece 12, and a limiting rod 13. The first connecting piece 11 and the second connecting piece are of a U-shaped structure. Specifically, the first connecting piece 11 comprises first side plates 111 disposed at an interval. The two first side plates 111 are arranged oppositely. A first bottom plate 112 is connected between the two first side plates 111. The second connecting piece 12 comprises second side plates 121 disposed at an interval. The two second side plates 121 are arranged oppositely. A second bottom plate 122 is connected between the two second side plates 121.

The first bottom plate 112 is used as a fixing plate, and every first bottom plate 112 is fixed to the sofa seat 100 by screws. The sofa leg 200 is welded and fixed with the second connecting pieces 12, or every second connecting piece 12 is fixed to the sofa leg 200 by screws.

The first side plates 111 are hinged to the second side plates 121 through shafts 101. Each second side plate 121 is located at an inner end of a corresponding first side plate 111. The first side plates 111 comprise a through hole 1111. The through hole 1111 is arc-shaped. The through hole 1111 is centered at a hinge joint of the first side plates and the second side plates. A path of the through hole 111 has at least one expansion groove 1112. As shown in FIG. 2, the path of the through hole 1111 has one expansion groove 1112, and the expansion groove 1112 is on one end of the through hole 1111. It is understood that the path of the through hole 1111 may also has a plurality of expansion grooves 1112 disposed at intervals to achieve multi-angle fixation. Specifically, two expansion grooves 1112 may be provided, and the two expansion grooves 1112 are respectively on two ends of the through hole 1111.

The limiting rod is axially movably connected with a corresponding second side plate 121. The limiting rod 13 is perpendicular to the second side plates 121, and the limiting rod 13 is moveable relative to the corresponding second side plate 121 along an axial direction of the limiting rod 13.

Figure 3:
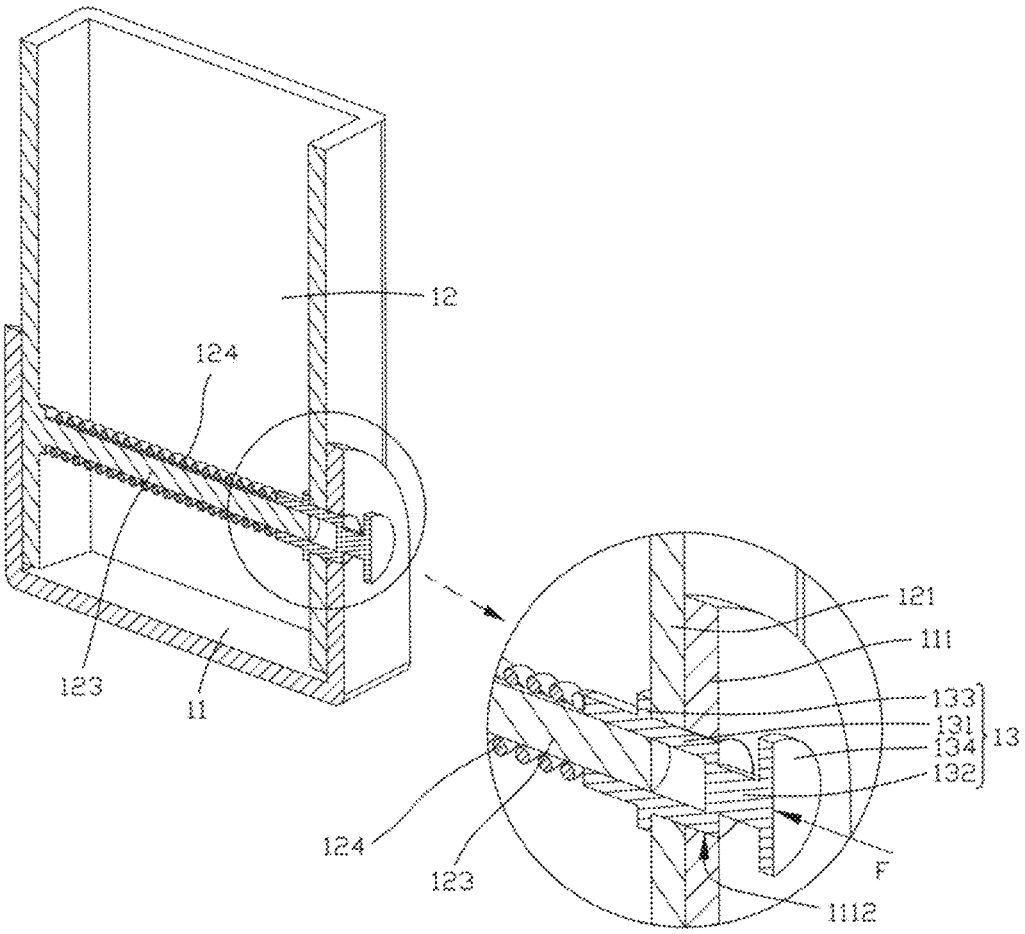
FIG. 3 is a cross-sectional view of a portion taken along the line A-A shown in FIG. 2.

As shown in FIG. 3, the limiting rod comprises a first sections 131 and a second section 132. The angle adjustment assembly according to claim 1, A first baffle 133 is disposed on the first section 131 of the limiting rod 13. A second baffle 134 is disposed on the second section 132 Of the limiting rod 13. The first baffle 133 and the second baffle 134 sandwich a corresponding first side plate 111 and a corresponding second side plate 121. A diameter of the first section 131 of the limiting rod 13 is smaller than a diameter of the second section 132 of the limiting rod 13. A size of the first section 131 of the limiting rod 13 matches a size of the through hole 1111. Therefore, when the first section 131 of the limiting rod 13 is aligned with the through hole 1111, the first section 131 1 of the limiting rod 13 is movable along the path of the through hole 1111. A size of the second section 132 of the limiting rod 13 matches the expansion groove 1112. The second section 132 is able to be received in the expansion groove 1112, but is unable to move along the path of the through hole 1111.

When the limiting rod 13 is axial moved, the first section 131 of the limiting rod 13 is received in the through hole 1111, or the limiting rod 13 is axial moved to make the second section 132 of the limiting rod 13 to be received in a corresponding expansion groove 1112. A stroke of the limiting rod 13 is a distance between the first baffle 133 and the second baffle 134.

The second connecting piece 12 comprises a guiding rod 123. One end of the guiding rod 123 is fixed to a corresponding second side plate. The other end of the guiding rod 123 extends toward the limiting rod 13 disposed on the other second side plate 121. The guiding rod 123 is axially inserted into the limiting rod 13. The limiting rod 13 is of a hollow pipe-shaped structure, and the guiding rod 123 is inserted into the limiting rod 13, so that when the limiting rod 13 moves axially, the guiding rod 123 is acted as a guide for axial movement of the limiting rod 13. A pretension spring 124 is sleeved on the guiding rod 123. The limiting rod 13 is connected with the pretension spring 124; The pretension spring 124 is configured to provide a pretension force to the limiting rod 13 to make the second section 132 of the limiting rod 13 to be received in the expansion groove 1112.

When the first section 131 of the limiting rod 13 is received in the through hole 1111, the pretension spring 124 abuts against an end surface of the second section 132 of the limiting rod 13 to make the second section of the limiting rod 13 abut against the corresponding first side plate 111, so that an angle of the second connecting piece 12 relative to the first connecting piece 11 is changed. When the limiting rod 13 moves along the path of the through hole 1111 to a position of the expansion groove 1112, the pretension spring 124 makes the limiting rod 13 move along an axial direction of an outer side of the guiding rod 123, so that the second section 132 of the limiting rod 13 is received in the expansion groove 1112, and the limiting rod 13 is fixed in the expansion groove 1112, thereby fixing the angle of the first connecting piece 11 with respect to the second connecting piece 12.

Figure 4:
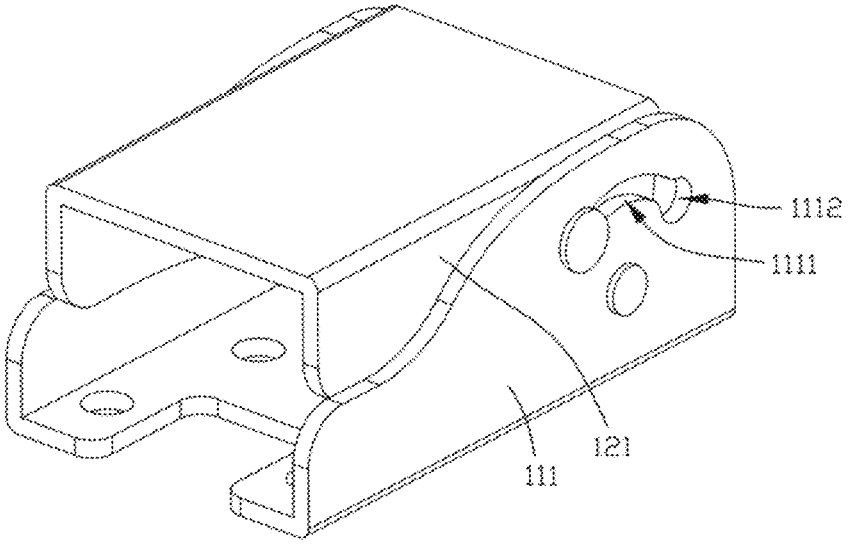
FIG. 4 is a schematic diagram showing the structures of the angle adjustment assembly where the angel adjustment assembly is in a folded state.

As shown in FIG. 3, when pressing force F is applied to the limiting rod 13, the pretension spring 124 is compressed, the second section 132 of the limiting rod 13 leaves the expansion groove 1112, and the first section 13 of the limiting rod enters the expansion groove 1112, so that the first section 131 of the limiting rod 13 move along the path of the through hole 1111 change the angle of the first connecting piece 11 with respect to the second connecting piece 12. FIG. 4 shows a situation where the angel adjustment assembly 10 is fully folded.

The above descriptions are only optional embodiments of the present disclosure and are not intended to limit the present disclosure. Any modification, equivalent replacement, or improvement made within the spirit and principle of the present disclosure shall be fall within the protection scope of the present disclosure.

What is claimed is:

1. An angle adjustment assembly, comprising:

a first connecting piece;

a second connecting piece; and a limiting rod, wherein the first connecting piece comprises first side plates; the second connecting piece comprises second side plates; the first side plates are hinged to the second side plates; the first side plates comprise a through hole; the through hole is arc-shaped; the through hole is centered at a hinge joint of the first side plates and the second side plates; a path of the through hole has at least one expansion groove; the limiting rod is axially movably connected with a corresponding second side plate; the limiting rod comprises a first sections and a second section; a diameter of the first section of the limiting rod is smaller than a diameter of the second section of the limiting rod; a size of the first section of the limiting rod matches a size of the through hole; a size of the second section of the limiting rod matches a size of the at least one expansion groove; the limiting rod is configured to be axial moved to make the first section of the limiting rod receive in the through hole or make the second section of the limiting rod receive in the at least one corresponding expansion groove.

2. The angle adjustment assembly according to claim 1, wherein the limiting rod is connected with a pretension spring; the pretension spring is configured to provide a pretension force to the limiting rod to make the second section of the limiting rod to be received in the at least one expansion groove.

3. The angle adjustment assembly according to claim 2, wherein the second connecting piece comprises a guiding rod, one end of the guiding rod is fixed to a corresponding second side plate; another end of the guiding rod is axially inserted into the limiting rod; the limiting rod is slidably connected with the guiding rod, the pretension spring is sleeved on the guiding rod.

4. The angle adjustment assembly according to claim 3, wherein the limiting rod is hollow, and the guiding rod is inserted into the limiting rod.

5. The angle adjustment assembly according to claim 1, wherein two ends of path of the through hole comprise a respective expansion groove.

6. The angle adjustment assembly according to claim 1, wherein one end of the path of the through hole comprises one expansion groove; when the second section of the limiting rod is received in the expansion groove, the second connecting piece is in an expanded state relative to the first connecting piece.

7. The angle adjustment assembly according to claim 3, wherein the first connecting piece and the second connecting piece are U-shaped in structure; the first connecting piece comprises two first side plates disposed at an interval; the second connecting piece comprises two second side plates disposed at an interval; one end of the guiding rod is fixed to the corresponding second side plate.

8. The angle adjustment assembly according to claim 7, wherein each second side plate is located at an inner end of a corresponding first side plate.

9. The angle adjustment assembly according to claim 1, wherein a first baffle is disposed on the first section of the limiting rod; a second baffle is disposed on the second section of the limiting rod; the first baffle and the second baffle sandwich a corresponding first side plate and a corresponding second side plate.

10. A sofa, comprising:

a first component;

a second component; and angle adjustment assemblies;

wherein each angle adjustment assembly comprises a first connecting piece, a second connecting piece, and a limiting rod;

wherein the first connecting piece comprises first side plates; the second connecting piece comprises second side plates; the first side plates are hinged to the second side plates; the first side plates comprise a through hole; the through hole is arc-shaped; the through hole is centered at a hinge joint of the first side plates and the second side plates; a path of the through hole has at least one expansion groove; the limiting rod is axially movably connected with a corresponding second side plate; the limiting rod comprises a first sections and a second section; a diameter of the first section of the limiting rod is smaller than a diameter of the second section of the limiting rod; a size of the first section of the limiting rod matches a size of the through hole; a size of the second section of the limiting rod matches a size of the at least one expansion groove; the limiting rod is configured to be axial moved to make the first section of the limiting rod receive in the through hole or make the second section of the limiting rod receive in the at least one corresponding expansion groove;

wherein the first component is connected to first connecting pieces; the second component is connected to second connecting pieces.

11. The sofa according to claim 10, wherein the first component is a sofa seat; the second component is a sofa leg.

12. The sofa according to claim 11, wherein the second component is a U-shaped sofa leg; the sofa comprises two angle adjustment assemblies; two ends of the second component are connected with a respective second connecting piece.

* * * * *